United States Patent [19]

Scholle

[11] 4,211,348

[45] Jul. 8, 1980

[54] DISPENSER SPIGOT

[76] Inventor: William R. Scholle, 3000 Via Mondo, Compton, Calif. 90224

[21] Appl. No.: 873,366

[22] Filed: Jan. 30, 1978

[51] Int. Cl.[2] ..... B65D 47/20

[52] U.S. Cl. ..... 222/498

[58] Field of Search ..... 222/511, 512, 517, 501, 222/498, 213; 251/280; 220/213

[56] References Cited

U.S. PATENT DOCUMENTS

| | | | |
|---|---|---|---|
| 3,400,866 | 9/1968 | Fattori | 222/511 |
| 3,595,445 | 7/1971 | Buford et al. | 222/511 X |
| 3,825,144 | 7/1974 | Wiedmer | 215/320 |
| 3,972,452 | 8/1976 | Welsh | 222/511 X |

*Primary Examiner*—Stanley H. Tollberg

*Attorney, Agent, or Firm*—Knobbe, Martens, Olson, Hubbard & Bear

[57] ABSTRACT

A spigot for dispensing the liquid contents of a container having a filling and dispensing spout adjacent the bottom thereof comprising an integral elastomeric member of generally cup shape having a peripheral wall complementary to and adapted to fit within and seal against the inner surface of the spout axially inwardly of the lip of the spout, a transverse wall at the inner end of said peripheral wall for closing off the spigot and the spout, and a manipulatable lever on said transverse wall for flexing said transverse wall and a portion of said peripheral wall to move said portion of said peripheral wall radially inwardly away from the spout to permit the dispensing of the contents of the container, said walls automatically and resiliently snapping back into their spout sealing positions upon release of said manipulatable means.

7 Claims, 3 Drawing Figures

DISPENSER SPIGOT

BACKGROUND OF THE INVENTION

Bag-in-box packaging of a variety of commodities is becoming increasingly more popular due to its economy, convenience and storage capabilities. The package, which is entirely disposable, consists of a flexible plastic bag for reception of the commodity in a sterile, air-free, noncontaminant environment, and a paperboard box for reception of the filled bag to facilitate safe transportion and handling of the same. The bag is equipped with a tubular spout through which the bag may be filled and the contents subsequently dispensed, and the box is provided with perforated tabs adjacent the location of the spout within the box to facilitate access to, removal of and mounting of the spout in a wall of the box near the bottom thereof for convenient gravity dispensing of the liquid contents. Examples of commodities economically packaged in this manner include milk, juice, and wine in one, three, five and ten gallon sizes, and even such viscous products as ketchup.

Manifestly, the spout must be equipped with a valve or spigot for controlling dispensing of the contents. A particularly successful form of spigot currently employed comprises an integral elastomeric member defining a diaphragmic transverse wall of deeply concave shape adapted to be inserted into the spout in sealing engagement with the outer end or lip of the spout and having finger manipulatable means on the wall for distorting a portion thereof from concave to convex configuration and disengaging said portion from the lip of the spout to permit dispensing of the contents, the wall snapping back into sealing position upon release of finger pressure. This spigot is shown and described in detail in U.S. Pat. No. 3,400,866 to L. A. Fattori, and an improved version in U.S. Pat. No. 3,443,728 to W. R. Scholle, the instant applicant.

As pointed out in the introductory portion of the Fattori patent, this spigot enjoys the advantages of being sufficiently low in cost for incorporation in a disposable container of the type above described; practical and efficient for shipping, storing and dispensing a wide variety of liquids including the special requirements for liquid food products, such as milk, juices and wine; operable at food refrigerating temperatures; neat and aesthetic in appearance; foolproof in operation; allowing optimum flow of liquid by exertion of finger pressure of one hand, leaving the other hand free for holding a receiving receptacle; providing rapid and automatic shut off upon release of the finger pressure; being free of drip or liquid hangup after shut off; and not leaking after passage of time or exposure to shock loading. In addition, because the spigot can be easily snapped onto and off of the spout, the spigot is compatible for filling containers through the delivery spout using high speed automatic machinery; closure of the container being effected after filling by snap-on engagement of the spigot which simultaneously loads the latter in prestressed shut off position.

However, the Fattori spigot suffers certain disadvantages in terms of its sealing effectiveness and pressure capacity. In particular, because the Fattori spigot effects its seal on the lip of the spout, it has little if any more than line contact with the spout at the seal and any nicks or deformities in the lip occurring during manufacture of the spout and/or the bag, shipping and handling of the empty bag and/or filling of the bag results in the spigot leaking and/or having very little resistance to internal pressure.

One effort to overcome some of these deficiencies of the Fattori spigot is shown in U.S. Pat. No. 3,972,452 to W. C. Welsh. As shown in this patent, the deeply concave wall of the Fattori spigot was further equipped with an axially inwardly extending cylindrical wall purportedly intended to gain additional bearing surface and sealing area on the interior surface of the spout. However, the attempt was marred by significant increase in the amount of material, and thus the cost, of the spigot and by increased difficulty in securing a wide open path for effective dispensing of the contents of the container.

SUMMARY OF THE INVENTION

The above described disadvantages of the prior art spigots of this particular type are overcome by forming the integral elastomeric member of flat-bottom, cylindrical, cut shape with a cylindrical peripheral wall that fits within and seals against the inner surface of the spout axially inwardly of the lip of the spout, a flat, circular transverse wall that closes off the spigot and the spout at the axially inner end of the cylindrical wall, and a finger manipulatable lever on said transverse wall for flexing part of said transverse wall and a portion of said peripheral wall radially inwardly and axially outwardly to a somewhat convex configuration to open up a large path of egress to permit the convenient dispensing of the contents of the container. Upon release of the lever, said walls resiliently pop back to their sealing positions to close off the spout.

By virtue of this construction, the seal between the spigot and the spout can be made of almost any area and compression force desired and is readily varied by the provision on the outer surface of the cylindrical wall of one or more annular sealing beads or ribs of variable area. Also, because the seal is now effective within the interior of the mouth of the spout rather than on the lip thereof, damage to and/or irregularities in the lip of the spout resulting from improper manufacture, handling and/or filling will have no adverse effect whatever on the seal.

Consequently, the seal provided by the spigot of this invention can withstand far greater internal pressures, will have far lower rates of oxygen and gas transmission, which is very important in the packaging of food products subject to deterioration by oxidation, and will have far less susceptibility to leakage even when used to package liquids having a great propensity for leaking, such as wine.

At the same time, all of these advantages are obtained without loss of the other advantageous characteristics of the Fattori spigot, and at absolutely no increase in cost.

Additional advantages of the present invention will become apparent in the following detailed description of the invention.

THE DRAWINGS

DETAILED DESCRIPTION

Figure 1:
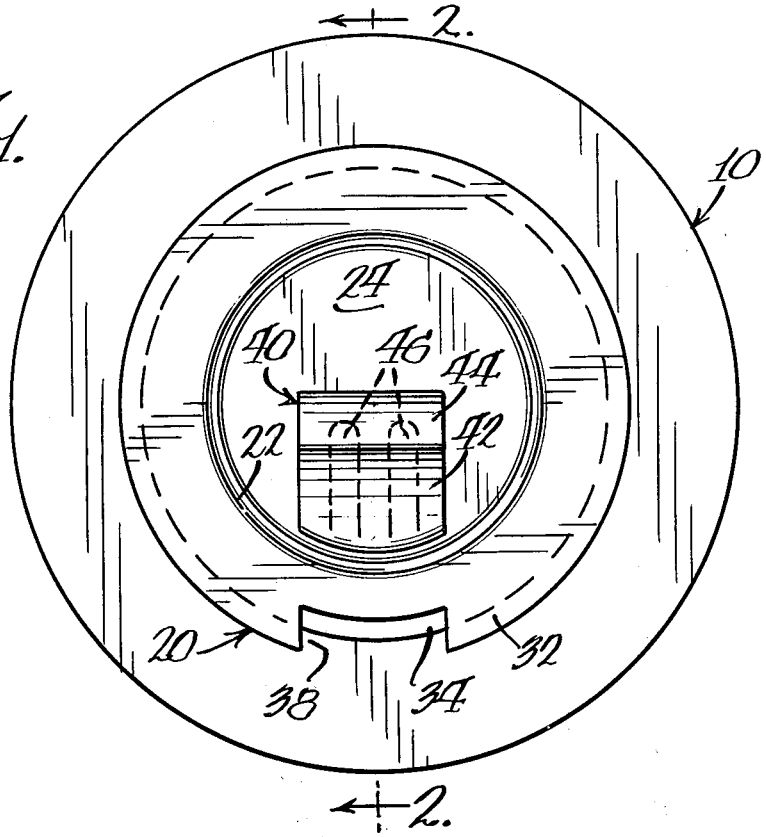
FIG. 1 is a front end view of the spigot of the invention.

Referring to the drawings, the numeral 10 denotes a tubular spout open at its ends and having a relatively large diameter outwardly extending flange 12 at its inner end for sealed connection with a container, such as the earlier described flexible bag used for bag-in-box packaging. Intermediate its ends, the spout is also provided with at least two axially spaced radially outwardly extending flanges 14 which are used in known manner to facilitate filling of the bag through the spout and to mount and lock the spout in an aperture adjacent the bottom of the box when it is desired to dispense the contents of the box. At its outer end or lip, the spout includes at least one relatively small diameter radially outwardly extending flange 16 which aids in retaining the spigot on the spout, as will subsequently appear.

The spigot of the present invention, which is indicated generally at 20, comprises an integrally molded elastomeric member of flat-bottom, cylindrical, cup shape having a cylindrical peripheral wall 22 of an outer diameter to fit snugly within the interior of the spout, and a flat, transverse, circular wall 24 at the axially inner end of the peripheral wall 22 for closing off the spigot and the spout. By virtue of its engagement with the interior wall of the spout, either in whole or part, the peripheral wall 22 completely seals off the spout. In the embodiment of the spigot illustrated in the drawings, the peripheral wall 22 is provided on its outer surface with a radially outwardly extending, annular sealing bead 26 which sealingly engages the interior wall of the spout well within the mouth of the spout axially inwardly from the lip thereof. The sealing area of the bead may be varied as desired and/or as necessary for particular purposes, and/or the cylindrical wall may be provided with a plurality of such beads in axially spaced relationship to one another to enhance the sealing characteristics. The sealing pressure and the sealing area of each sealing bead may be adjusted by making the beads of very slightly greater and/or smaller diameter thereby to increase or decrease the sealing force and area when the spigot is press-fitted into the spout. The seal is preferably effected by means of one or more of the beads 26, rather than the entirety of the cylindrical wall 22 itself, since the beads assure greater accuracy in the formation of the seal, both as to sealing area and sealing pressures.

Because of the manner in which and the location at which the seal is effected, the spigot of the present invention is capable of withstanding large internal and external pressures without leaking liquid out of or air into the bag. Also, because of the relatively large area of the seal (as opposed to line contact), the spigot has great resistance to transmission of gases, for example osmotic transmission of oxygen, and therefore insures the preservation of the contained product even when stored for long periods of time before being dispensed or for long periods of time between dispensings. Because the flexible bag collapses without entry of air as the contents are dispensed, the provision of a gas resistant seal is important to the overall integrity of the package, and this is achieved by the invention. Also, since the seal is effected deep in the mouth of the spigot, nicks and/or other imperfections in or damage to the lip of the spout will have no adverse effect whatever on the spigot or the seal.

For securely but detachably mounting the spigot on the spout, the spigot includes a mounting collar 30 comprised of a short radially outwardly extending flange 32 at the axially outer end of the cylindrical wall 22 and a second cylindrical peripheral wall 34 extending axially inward from a location generally centrally of the flange 32 in spaced parallel relation to the wall 22. The walls 22, 32 and 34 together define a flat-bottom, cylindrical recess for slidable reception of the lip and outer portions of the spout. The wall 34 is of a length to abut against the outermost of the flanges 14, thereby to define a stop for predetermination of the extent of insertion of the spigot into the spout. The wall 34 is also provided immediately inwardly of the flange 16 on the spout with a complementary annular flange 36 for detachably locking the spigot to the spout.

Figure 2:
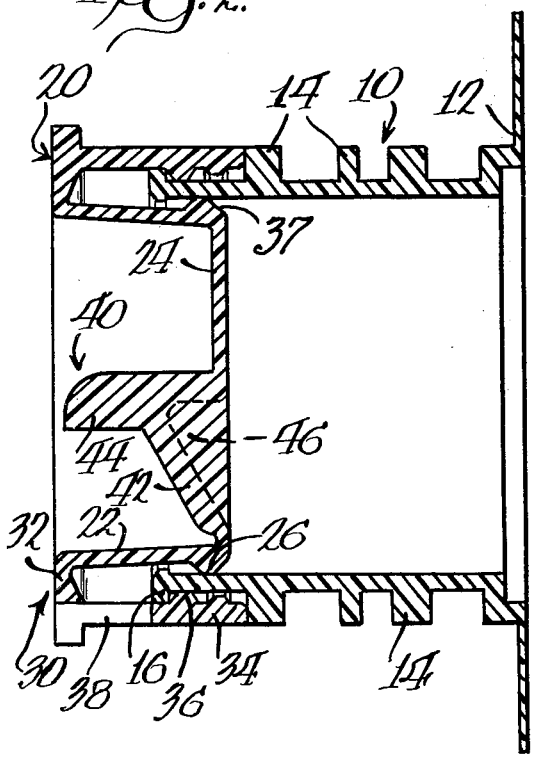
FIG. 2 is a vertical section of the spigot, taken substantially on line 2—2 of FIG. 1, showing the spigot in closed position.

As shown particularly in FIG. 2, the axially inner end of the cylindrical wall 22 at its juncture with the transverse wall 24 is tapered at 37, and the opposite surfaces of the flanges 16 and 36 are tapered and/or rounded, to facilitate insertion of the spigot into and removal of the spigot from the spout. The portions of the flange 32 extending radially outwardly from the wall 34 provide a convenient gripping area for either manual or automated removal of the spigot to facilitate filling of the bag through the spout, followed by reapplication of the spigot to the spout. Thus, the spigot may be applied to the spout at the time of manufacture of the bag to maintain internal sterility during transport and handling of the empty bag, as well as after the filling thereof.

To provide for dispensing of the liquid in a predetermined and preoriented location and stream of flow, an arcuate portion of the flange 32 and the outer peripheral wall 34 outwardly of the lip of the spout are omitted (i.e., blocked out in the molding of the spigot), thereby to define a dispensing opening 38 at the bottom of the spigot.

The spigot is operated by finger manuipulatable means formed integrally with the transverse wall 24 and indicated generally at 40. Said means, as shown in FIG. 1, occupies a generally rectangular area extending from a limited arcuate portion of the juncture of the walls 22 and 24 aligned with and adjacent the opening 38 radially inwardly to about the horizontal center of the wall 24. As viewed in cross-section (FIG. 2), the means 40 comprises a triangular base portion 42 extending radially inwardly and axially outwardly from the juncture of the walls 22 and 24 and terminating in a horizontal surface perpendicular to the transverse wall 24. Formed integrally with the base 42 at the apex thereof is a finger engageable lever 44 which extends horizontally and axially outwardly from the base perpendicular to the wall 24, but which terminates inwardly of the outer edge of the outermost flange 32 of the spigot. Consequently, the finger manipulatable means 40 is housed entirely within the cylindrical recess defined by the walls 22 and 24 so that the same cannot accidentally or inadvertently be operated during shipment, handling or storage of the container. Overt, intentional action by an operater is required, so that inadvertent opening of the spigot and loss of the contents is prevented.

Figure 3:
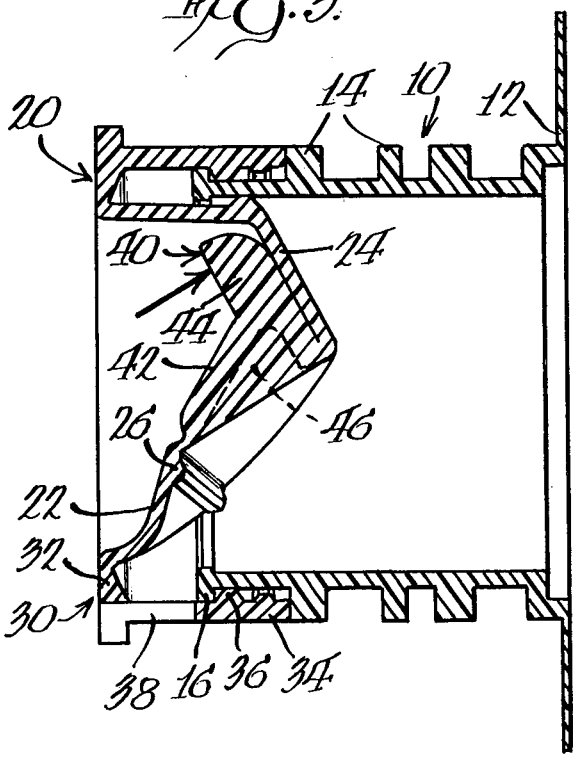
FIG. 3 is a vertical section of the spigot showing the same in open position.

In use, with the spigot oriented at the bottom of a container in the position shown in FIGS. 1 and 2, a person may dispense the contents of the container by placing a receptacle under the opening 38 and pressing upwardly on the lever 44. As the user presses upwardly on the lever, the arcuate portion of the juncture between the walls 22 and 24 which is encompassed by the base 42 is moved in an arcuate path radially inwardly and axially outwardly until the same, together with the adjacent portions of the walls 22 and 24, assumes a generally convex configuration as shown in FIG. 3. During the movement of the base, arcuate portions of the walls 22 and 24 aligned with the opening 38, together with the corresponding arcuate portion of the sealing bead 26, are moved radially inwardly away from the inner surface of the spout, thereby to open a large path of egress in communication with the opening 38 to permit dispensing of the liquid contents of the container. Upon release of the lever 44, the walls 22 and 24 snap or pop resiliently back to their normal positions to thereby close and seal the spout without dripping or leakage at the opening 38.

The width of the base portion 42 of the finger operated means insures quick opening and quick closing of a large path of egress from the container for convenient, dripless dispensing of both viscous materials and liquids. The degree of ease in operating the lever, as well as the degree of snap action provided by the base, and also the size of the path of egress may be varied by the provision of tapered slots 46 in the axially inward surface of the transverse wall 24 behind the base 42.

Thus, the present invention provides an integral elastomeric dispensing spigot having all the advantages and economy of the Fattori spigot, and having greatly enhanced sealing and dispensing characteristics as well.

While a preferred embodiment of the invention has been illustrated and described herein, it is to be appreciated that various changes, rearrangements and modifications may be made therein without departing from the scope of the invention, as defined by the appended claims.

What is claimed is:

1. A dispensing spigot for a container having a spout comprising an integral elastomeric member of generally cup shape having a peripheral wall complementary to and adapted to fit within the spout axially inwardly of the lip of the spout, said peripheral wall having at least one sealing bead on the outer surface thereof for sealing engagement with the inner surface of the spout axially inwardly from the lip thereof, a transverse wall at the inner end of said peripheral wall for closing the spigot and the spout, and manipulatable means extending from said transverse wall for flexing said transverse wall and a portion of said peripheral wall and sealing bead in a toggle effect to move said portion of said peripheral wall and sealing bead radially inwardly away from the spout to permit the dispensing of the contents of the container while other portions of said seal remain against said spout.

2. A spigot as set forth in claim 1, said at least one sealing bead comprising outwardly projecting bead means on the outer surface of said peripheral wall for sealing engagement with the inner surface of the spout, the degree of sealing being variable by varying the number and size of the beads.

3. A spigot as set forth in claim 1, including an integral collar joined to said peripheral wall at the outer end thereof and having a second peripheral wall spaced outwardly from the first named peripheral wall for detachable engagement with the outer surface of the spout for detachably but securely mounting the spigot on the spout.

4. A spigot as set forth in claim 1, said manipulatable means occupying a generally rectangular portion of the area of said transverse wall extending from adjacent a limited portion of the juncture of the transverse wall with the inner surface of said peripheral wall to approximately the horizontal center line of said transverse wall, said manipulatable means in cross-section comprising a triangular base portion extending radially inwardly and axially outwardly from the juncture of said transverse and peripheral walls at said limited portion thereof, and an axially outwardly extending finger lever at the apex of said base portion, said lever upon movement in the direction radially away from said limited portion causing said limited portions of said transverse and peripheral walls and said sealing bead to be flexed radially inwardly and axially outwardly into a somewhat convex configuration whereby to move the same radially away from the spout to permit the dispensing of the contents of the container, said limited portions resiliently snapping back into their normal spout sealing position upon release of said lever.

5. A spigot as set forth in claim 4, including an integral collar joined to said peripheral wall at the outer end thereof and having a second peripheral wall spaced outwardly from the first named peripheral wall for detachable engagement with the outer surface of the spout for detachably but securely mounting the spigot on the spout, said collar having an opening therein aligned with said limited portion of said peripheral wall.

6. A dispensing spigot as set forth in claim 1 said peripheral wall and seal automatically and resiliently snapping back into their spout sealing position upon release of said manipulatable means.

7. A dispensing spigot for a container having a tubular spout comprising an integral elastomeric member of flat-bottom, cup shape having a cylindrical peripheral wall complementary to and adapted to fit within the spout axially inwardly of the lip of the spout, said peripheral wall having at least one annular sealing bead on the outer surface thereof for sealing engagement with the inner surface of the spout axially inwardly from the lip thereof, a flat, circular transverse wall at the axially inner end of said peripheral wall for closing off the spigot and the spout, and manipulatable means extending from said transverse wall generally centrally of the axially outer surface of said transverse wall within the hollow defined by said cylindrical wall adapted to be manually manipulated for flexing said transverse wall and a portion of said peripheral wall and sealing bead in a toggle effect to move said portion of said peripheral wall and sealing bead radially inwardly away from the spout to permit the dispensing of the contents of the container while other portions of said seal remain against said spout, said walls and sealing bead automatically and resiliently snapping back into their spout sealing position upon release of said manipulatable means.

* * * * *